US012287112B2

(12) United States Patent
Liu et al.

(10) Patent No.: US 12,287,112 B2
(45) Date of Patent: Apr. 29, 2025

(54) MIDDLE AIR DUCT SUPPORT MEMBER AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Taisheng Liu, Guangdong (CN); Zhiqiang Liu, Guangdong (CN); Zhiqiang Yang, Guangdong (CN); Zeping Li, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 602 days.

(21) Appl. No.: 17/546,309

(22) Filed: Dec. 9, 2021

(65) Prior Publication Data

US 2022/0099330 A1 Mar. 31, 2022

Related U.S. Application Data

(63) Continuation of application No. PCT/CN2019/119944, filed on Nov. 21, 2019.

(30) Foreign Application Priority Data

Jun. 11, 2019 (CN) ..... 201920874343.9

(51) Int. Cl.
*F16L 13/02* (2006.01)
*F24F 13/02* (2006.01)
(Continued)

(52) U.S. Cl.
CPC ..... *F24F 13/0254* (2013.01); *F24F 13/0209* (2013.01); *F24F 13/20* (2013.01);
(Continued)

(58) Field of Classification Search
CPC .... F24F 13/0254; F24F 13/0209; F24F 13/20; F24F 13/18; F24F 2221/02; F24F 2221/26; F24F 13/02; F24F 13/32
See application file for complete search history.

(56) References Cited

U.S. PATENT DOCUMENTS 2,069,816 A * 2/1937 Child ..... F24F 1/0071 62/331
5,753,000 A * 5/1998 Chiu ..... F24F 8/108 55/357

(Continued)

FOREIGN PATENT DOCUMENTS

CN 204629964 U 9/2015
CN 108278752 A 7/2018

(Continued)

OTHER PUBLICATIONS

International Search Report dated Mar. 12, 2020 received in International Application No. PCT/CN2019/119944, together with an English-language translation.

*Primary Examiner* — David Bochna
(74) *Attorney, Agent, or Firm* — Scully, Scott, Murphy & Presser, P.C.

(57) ABSTRACT

A middle air duct support member and an air conditioner provided. The middle air duct support member has an annular first support portion and an annular second support portion arranged at an axial end of the first support portion. The second support portion and the first support portion are manufactured separately.

8 Claims, 7 Drawing Sheets

(51) Int. Cl.

| | |
|---|---|
| ***F24F 13/20*** | (2006.01) |
| *F24F 1/005* | (2019.01) |
| *F24F 13/18* | (2006.01) |

(52) U.S. Cl.
CPC ..... *F24F 1/005* (2019.02); *F24F 13/18* (2013.01); *F24F 2221/02* (2013.01); *F24F 2221/26* (2013.01)

(56) References Cited

U.S. PATENT DOCUMENTS

| | | | | |
|---|---|---|---|---|
| 11,454,416 | B2 * | 9/2022 | Yan | F24F 13/0209 |
| 2017/0191692 | A1 * | 7/2017 | Hwang | F24F 13/20 |
| 2021/0325080 | A1 * | 10/2021 | Mao | F24F 13/20 |

FOREIGN PATENT DOCUMENTS

| | | | |
|---|---|---|---|
| CN | 207962884 | U | 10/2018 |
| CN | 210118944 | U | 2/2020 |
| CN | 210118945 | U | 2/2020 |
| JP | H08-145397 | A | 6/1996 |
| JP | 2016-188717 | A | 11/2016 |

* cited by examiner

MIDDLE AIR DUCT SUPPORT MEMBER AND AIR CONDITIONER

CROSS-REFERENCE TO RELATED APPLICATIONS

The present application is a continuation application of PCT International Application No. PCT/CN2019/119944, filed on Nov. 21, 2019, which claims priority to and the benefit of Chinese Patent Application No. 201920874343.9, field on Jun. 11, 2019, the entire contents of which are incorporated herein by reference for all purposes. No new matter has been introduced.

FIELD

The present disclosure relates to the field of air conditioning technologies, and in particular to a middle air duct support member and an air conditioner.

BACKGROUND

In related technologies, air conditioners generally integrate a purification function. For example, a vertical air conditioner includes an upper air supply part, a middle air duct support member and a lower air inlet part, and the middle air duct support member is connected between the upper air supply part and the lower air inlet part. A support portion of the middle air duct support member is of an integrated structure, which brings difficulties to processing and manufacturing and is not conducive to mold opening.

SUMMARY

The present disclosure is intended to solve at least one of the technical problems existing in the prior art. For this reason, an objective of the present disclosure is to provide a middle air duct support member, which has a simple structure and is convenient for processing and manufacturing.

The present disclosure further provides an air conditioner including the above-mentioned middle air duct support member.

The middle air duct support member according to an embodiment of the present disclosure includes an annular first support portion; and an annular second support portion arranged at an axial end of the first support portion. The second support portion and the first support portion are manufactured separately.

In the middle air duct support member according to the embodiment of the present disclosure, since the first support portion and the second support portion are manufactured separately, mold opening can be carried out on the first support portion and the second support portion separately, which is beneficial to reducing the difficulty of mold processing and manufacturing, thereby reducing the difficulty of production; moreover, the first support portion and the second support portion can be manufactured at the same time, which is beneficial to improving the processing efficiency.

According to some embodiments of the present disclosure, at least one of the first support portion and the second support portion is provided with a reinforcement portion, and the reinforcement portion abuts between the first support portion and the second support portion.

According to some embodiments of the present disclosure, an inner peripheral wall of the first support portion is provided with a reinforcement plate that is folded in an axial direction after extending inwardly in a radial direction, the reinforcement plate defines the reinforcement portion, at least part of the second support portion extends into the first support portion, and part of the inner peripheral wall of the first support portion and a free end of the reinforcement plate abut against an outer peripheral wall of the second support portion, respectively.

According to some embodiments of the present disclosure, a first stepped portion is formed on the inner peripheral wall of the first support portion, and a second stepped portion abutting against the first stepped portion is formed on the outer peripheral wall of the second support portion.

According to some embodiments of the present disclosure, the second support portion includes: an annular chassis arranged on an end surface of an axial end of the first support portion; an annular first connecting section having one end connected to a radial inner end of the chassis and the other end extending into the first support portion in an axial direction; an annular second connecting section having one end connected to the other end of the first connecting section and the other end extending inwardly in a radial direction; and an annular third connecting section having one end connected to the other end of the second connecting section and the other end extending in the axial direction away from the first connecting section. The second connecting section and the third connecting section define the second stepped portion and the free end of the reinforcement plate abuts against the other end of the third connecting section.

According to some embodiments of the present disclosure, the reinforcement plate extends along a circumferential direction to form an open-loop shape.

According to some embodiments of the present disclosure, the middle air duct support member further includes a decorative member arranged on at least one of the outer peripheral walls of the first support portion and the second support portion.

According to some embodiments of the present disclosure, the decorative member includes: a decorative board detachably arranged on the outer peripheral wall of the first support portion; and a light source box provided therein with a light-emitting strip and located between the decorative board and the outer peripheral wall of the first support portion.

According to some embodiments of the present disclosure, the first support portion is provided with screw holes, an inner surface of the decorative board is provided with screw studs that are fitted with the screw holes, and the screw stud is defined with a notch running through the screw stud along an axial direction of the screw stud.

The air conditioner according to an embodiment of the present disclosure includes the above-mentioned middle air duct support member.

In the air conditioner according to the embodiment of the present disclosure, since the above-mentioned middle air duct support member is arranged and the first support portion and the second support portion are manufactured separately, mold opening can be carried out on the first support portion and the second support portion separately, which is beneficial to reducing the difficulty of mold processing and manufacturing, thereby reducing the difficulty of production; moreover, the first support portion and the second support portion can be manufactured at the same time, which is beneficial to improving the processing efficiency.

The additional aspects and advantages of the present disclosure will be set forth in part in the following description and become apparent in part from the following description or be understood through the practice of the present disclosure.

BRIEF DESCRIPTION OF THE DRAWINGS

The above-described and/or additional aspects and advantages of the present disclosure will become apparent and readily understood from the description of embodiments in conjunction with the following accompanying drawings, where.

Figure 1:
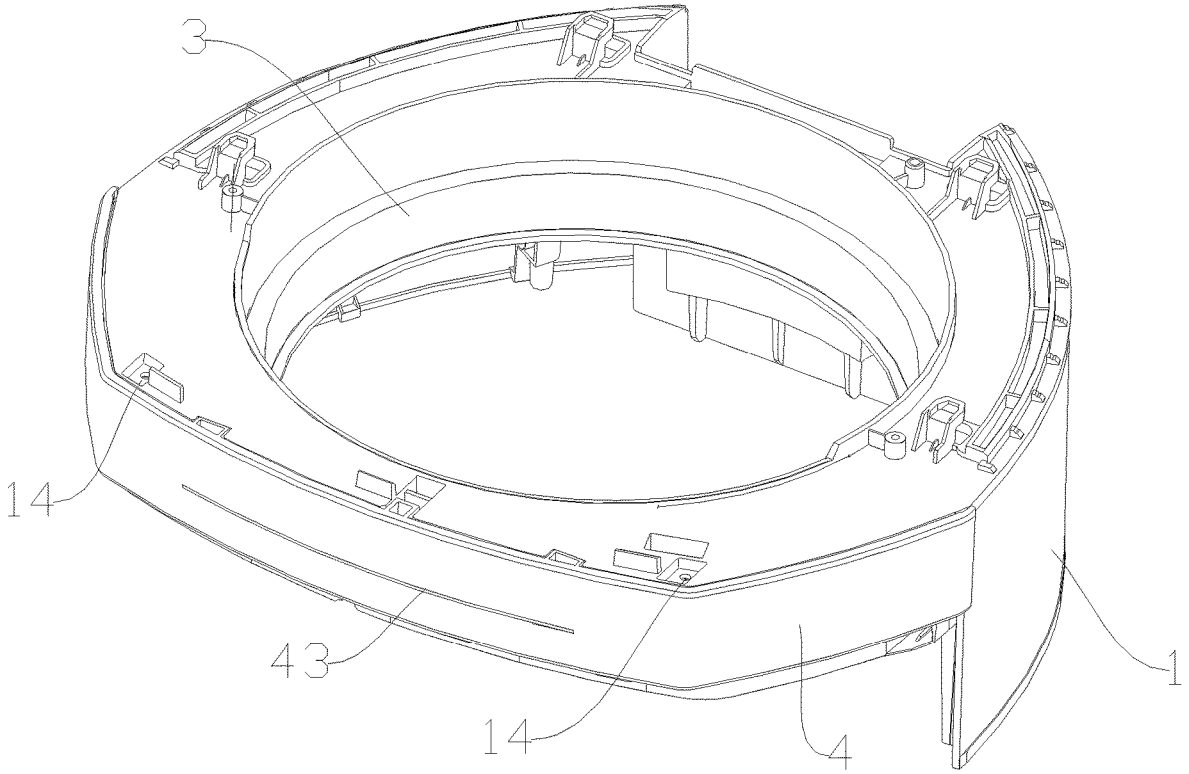
FIG. 1 is a schematic diagram of a first support portion and a decorative member according to some embodiments of the present disclosure when fitted.

Descriptions of the reference numerals in the drawings are as follows:

middle air duct support member 100;

first support portion 1; first stepped portion 11; fourth stepped portion 12; locking groove 13; screw hole 14;

second support portion 2; chassis 21; first connecting section 22; second connecting section 23; third connecting section 24; second stepped portion 2*a*; stepped portion 25;

reinforcement plate 3; flanging 31;

decorative plate 4; screw stud 41; notch 411; locking portion 42; first transparent portion 43;

light source box 5; lamp holder 51; lamp cover 52; second transparent portion 511;

air conditioner 1000; upper housing 200; lower housing 300.

DETAILED DESCRIPTION OF EMBODIMENTS

Embodiments of the present disclosure will be described below in detail. Examples of the embodiments are illustrated in the accompanying drawings, where the same or similar reference numerals throughout the specification refer to the same or similar elements or elements having the same or similar functions. The embodiments described below with reference to the accompanying drawings are exemplary and are intended to be illustrative only and are not to be construed as limiting the scope of the present disclosure.

A middle air duct support member 100 of an air conditioner 1000 according to an embodiment of the present disclosure and the air conditioner 1000 will be described below with reference to the accompanying drawings. Optionally, the air conditioner 1000 may be configured as a cabinet air conditioner indoor unit, a wall-mounted air conditioner indoor unit, a mobile air conditioner, or a window air conditioner.

Figure 4:
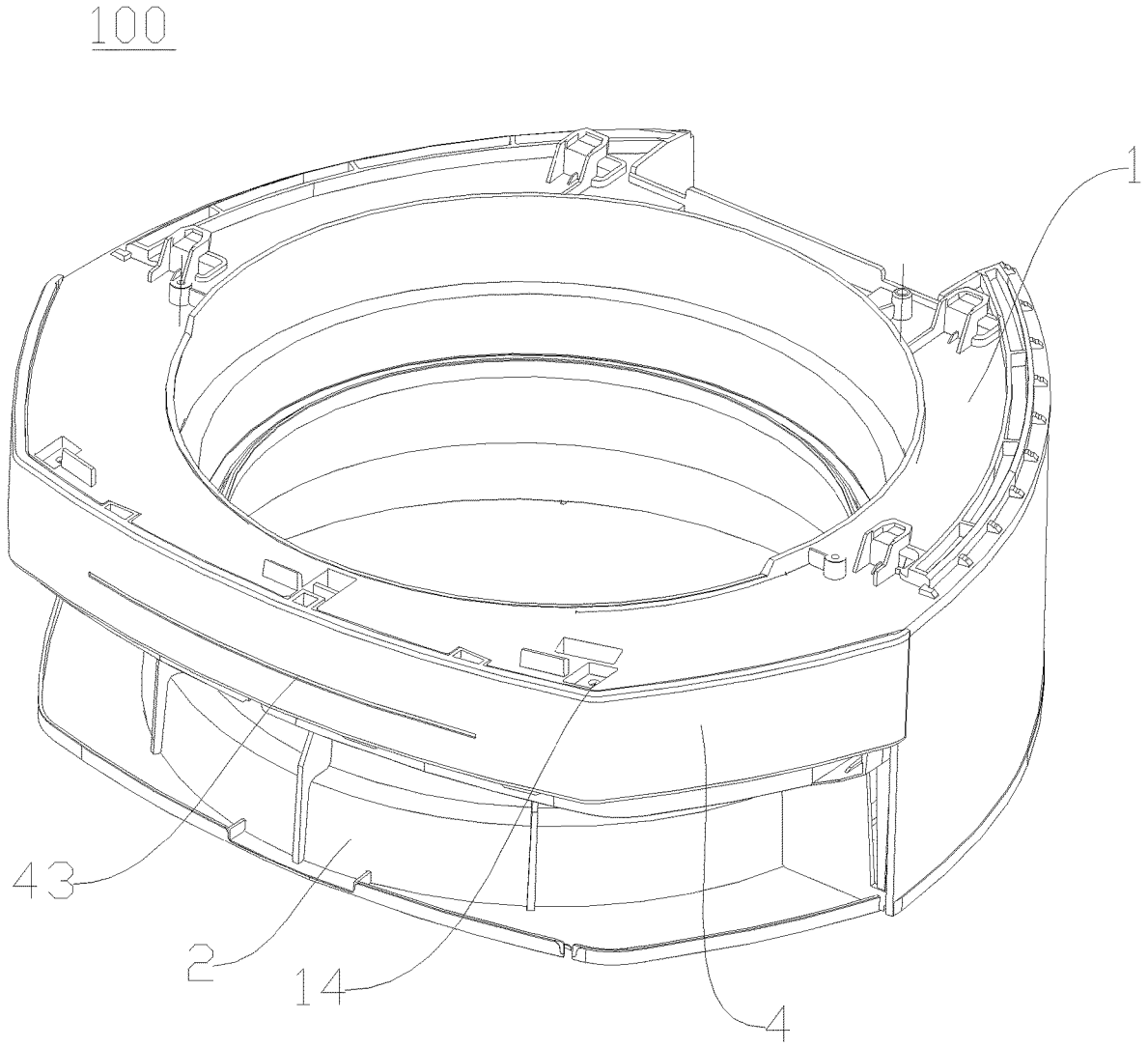
FIG. 4 is a schematic diagram of a middle air duct support member according to some embodiments of the present disclosure.
Figure 5:
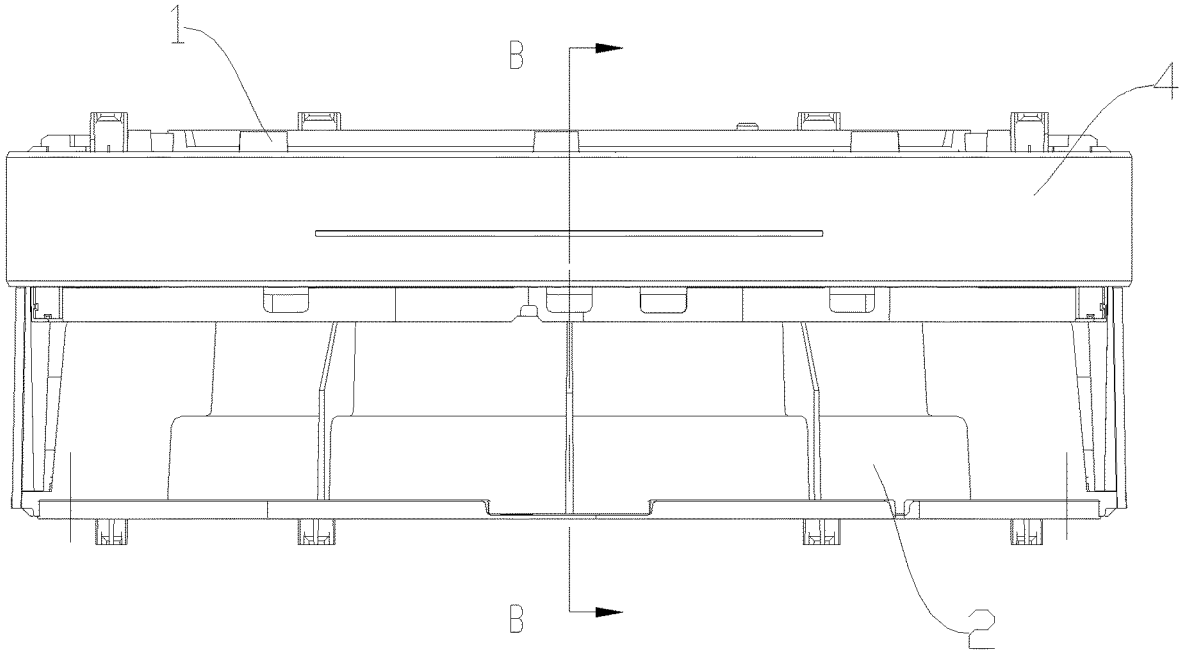
FIG. 5 is a schematic diagram of a middle air duct support member according to some embodiments of the present disclosure in another direction.

As shown in FIGS. 4 to 5, the middle air duct support member 100 of the air conditioner 1000 according to the embodiment of the present disclosure includes an annular first support portion 1 and an annular second support portion 2. For example, the first support portion 1 has a closed loop portion, and the second support portion 2 is shaped as a closed loop.

The second support portion 2 is arranged at an axial end of the first support portion 1. For example, an end surface of an axial end of the second support portion 2 is connected to an end surface of the axial end of the first support portion 1. For another example, the axial end of the second support portion 2 extends into the first support portion 1 from the axial end of the first support portion 1. For yet another example, the axial end of the first support portion 1 extends into the second support portion 2 from the axial end of the second support portion 2.

Figure 10:
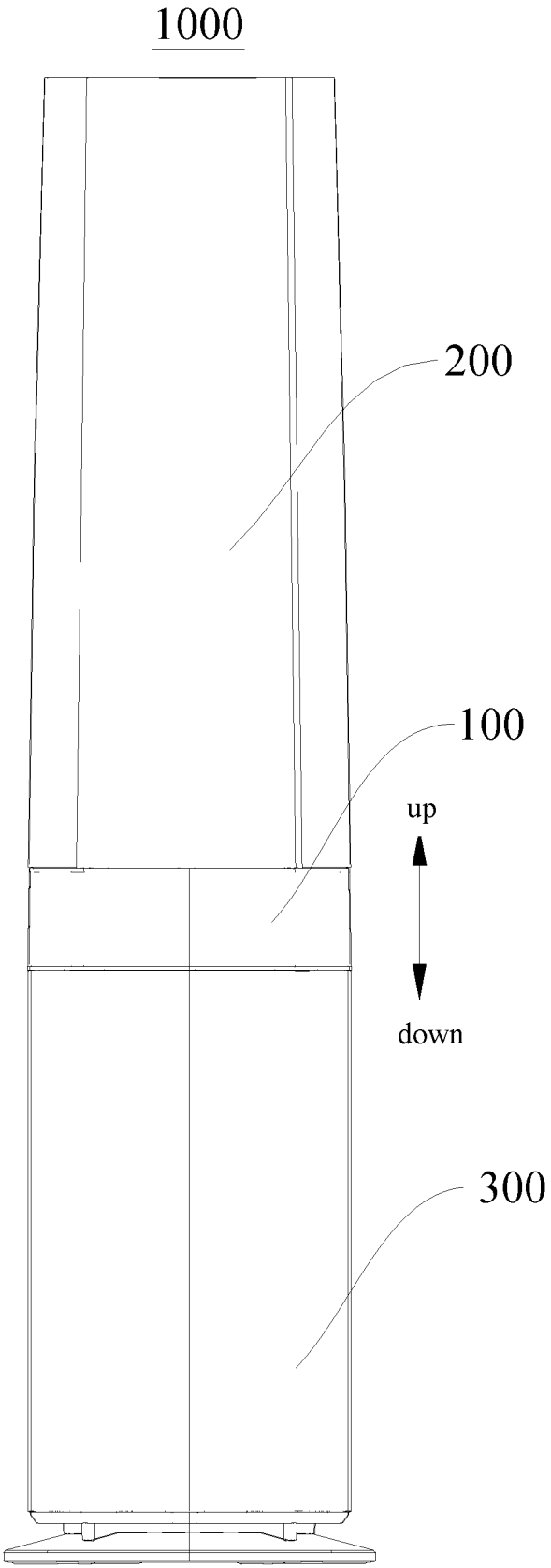
FIG. 10 is a schematic diagram of an air conditioner according to some embodiments of the present disclosure.

For example, the first support portion 1 and the second support portion 2 can form a hollow structure with two open ends in an axial direction after being fitted. The middle air duct support member 100 may further include an air duct body, the air duct body is arranged in the hollow structure, and the first support portion 1 and the second support portion 2 function to protect the air duct body. As shown in FIG. 10, the air conditioner 1000 may include an upper housing 200 and a lower housing 300, the middle air duct support member 100 is located between the upper housing 200 and the lower housing 300, and the air duct body is configured to supply air from the bottom to the top inside the air conditioner 1000.

Since the first support portion 1 and the second support portion 2 are manufactured separately, mold opening can be carried out on the first support portion 1 and the second support portion 2 separately, which is beneficial to reducing the difficulty of mold processing and manufacturing, thereby reducing the difficulty of production. Moreover, the first support portion 1 and the second support portion 2 can be manufactured at the same time, which is beneficial to improving the processing efficiency.

In the middle air duct support member 100 according to the embodiment of the present disclosure, since the first support portion 1 and the second support portion 2 are manufactured separately, mold opening can be carried out on the first support portion 1 and the second support portion 2 separately, which is beneficial to reducing the difficulty of mold processing and manufacturing, thereby reducing the difficulty of production. Moreover, the first support portion 1 and the second support portion 2 can be manufactured at the same time, which is beneficial to improving the processing efficiency.

Optionally, the first support portion 1 includes a first annular plate and a second annular plate, the first annular plate is arranged around the second annular plate and spaced apart from the second annular plate, and two axial ends of the first annular plate and two axial ends of the second annular plate are respectively connected by connecting plates. Therefore, by arranging multiple layers of plates, the air duct body can be better separated from the indoor environment, thereby improving the sealing performance of the middle air duct support member 100, reducing the transmission of noise from the air duct body to the outside, and improving user experience.

In some embodiments of the present disclosure, at least one of the first support portion 1 and the second support portion 2 is provided with a reinforcement portion, and the reinforcement portion is provided between the first support portion 1 and the second support portion 2 and abuts against the other one of the first support portion 1 and the second support portion 2. That is, when the first support portion 1 is provided with a reinforcement portion, a free end of the reinforcement portion abuts against the second support portion 2; alternatively or additionally, when the second support portion 2 is provided with a reinforcement portion, the free end of the reinforcement portion abuts against the first support portion 1. Therefore, by arranging the reinforcing portion, it is beneficial to improving the fitting strength between the first support portion 1 and the second support portion 2.

Figure 6:
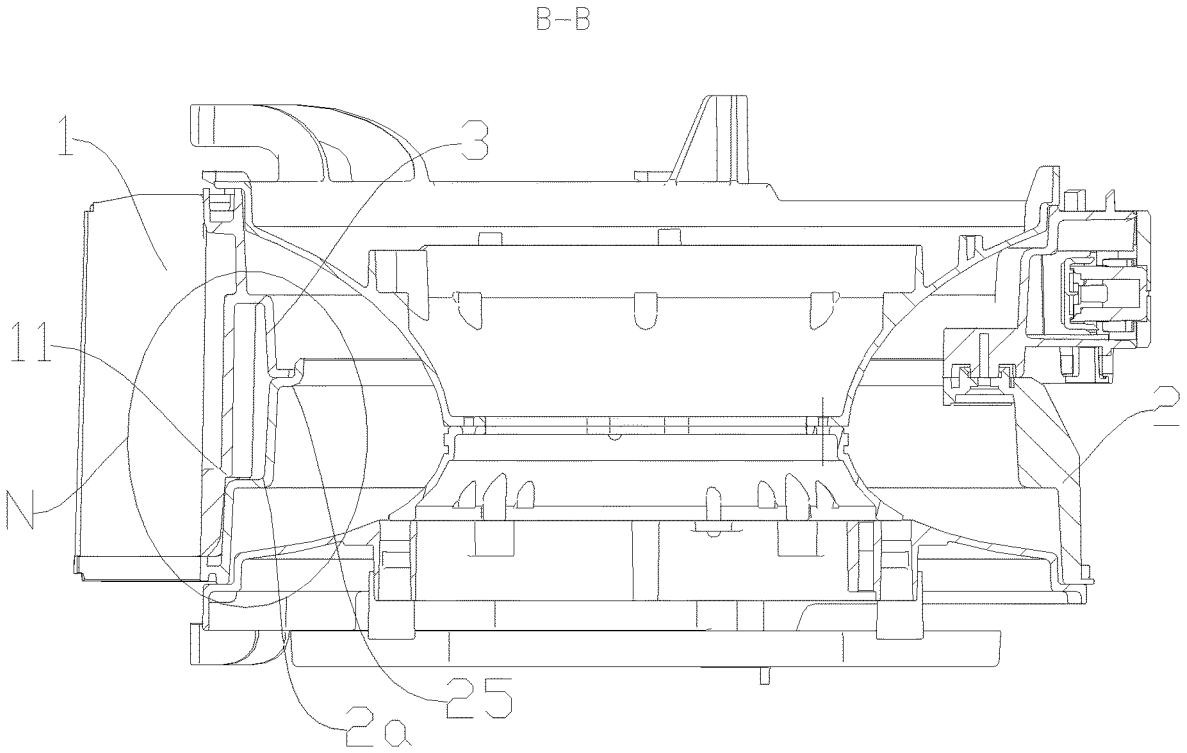
FIG. 6 is a cross-sectional view taken along direction B-B in FIG. 5.

For example, referring to FIG. 6, an inner peripheral wall of the first support portion 1 (e.g., an inner peripheral wall of the second annular plate described above) is provided with a reinforcement plate 3 that is folded in an axial direction after extending inwardly in a radial direction, the reinforcement plate 3 defines the reinforcement portion, at least part of the second support portion 2 extends into the first support portion 1, and part of the inner peripheral wall of the first support portion 1 and a free end of the reinforcement plate 3 abut against an outer peripheral wall of the second support portion 2, respectively. For example, as shown in FIG. 6, one end of the reinforcement plate 3 is arranged on the inner peripheral wall of the first support portion 1, and the other end of the reinforcement plate 3 extends inwardly in the radial direction and then folds downward in the axial direction. The second support portion 2 extends into the first support portion 1 from a lower axial end of the first support portion 1. Part of the inner peripheral wall of the first support portion 1 and the free end of the reinforcement plate 3 respectively abut against the outer peripheral wall of a part, located in the first support portion 1, of the second support portion 2. Therefore, by arranging the reinforcement portion as the reinforcement plate 3, it is beneficial to improving the fitting strength between the first support portion 1 and the second support portion 2, and the processing and manufacturing of the first support portion 1 can be facilitated and mold opening can be facilitated.

Optionally, the reinforcement plate 3 and the first support portion 1 are integrally formed parts. Therefore, it is beneficial to improving the connection strength between the reinforcement plate 3 and the first support portion 1 and simplifying the processing technology.

Further, as shown in FIG. 6, one end of the second support portion 2 located in the first support portion 1 is formed as a stepped portion 25, and the stepped portion 25 abuts against the free end of the reinforcement plate 3. Therefore, by arranging the stepped portion 25, the free end of the reinforcement plate 3 can abut against one of step surfaces (e.g., a horizontal step surface shown in FIG. 6) of the stepped portion 25 and the other step surface (e.g., a vertical step surface shown in FIG. 6) can function to limit the position of the reinforcement plate 3, which is beneficial to improving the reliability of the abutment between the reinforcement plate 3 and the second support portion 2, thereby improving the fitting reliability of the first support portion 1 and the second support portion 2.

In the middle air duct support member 100 according to the embodiment of the present disclosure, by arranging the stepped portion 25, the free end of the reinforcement plate 3 can abut against one of the step surfaces of the stepped portion 25 and the other step surface can function to limit the position of the reinforcement plate, which is beneficial to improving the reliability of the abutment between the reinforcement plate and the second support portion, thereby improving the fitting reliability of the first support portion 1 and the second support portion 2.

Figure 3:
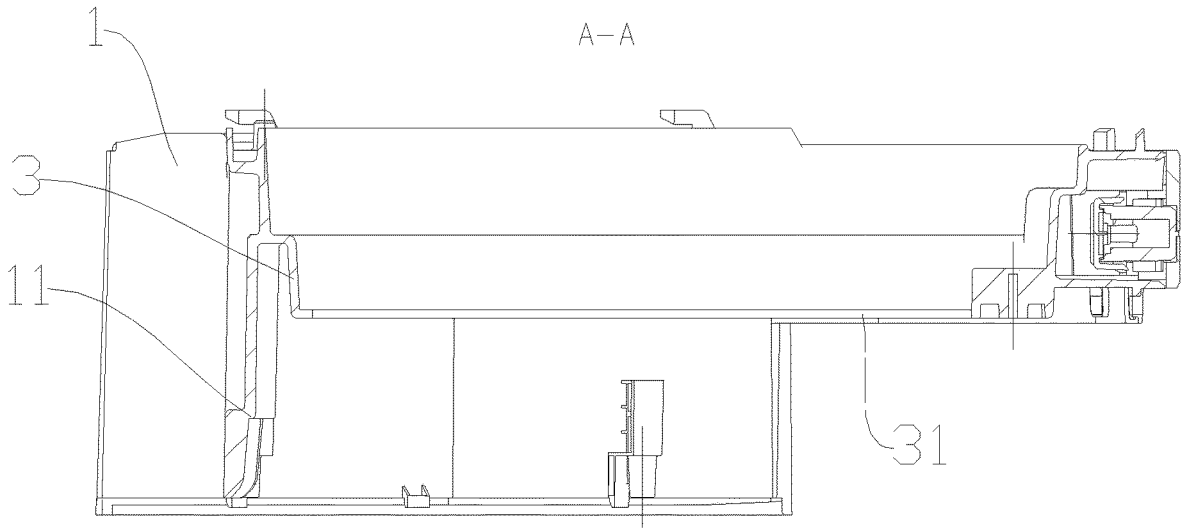
FIG. 3 is a cross-sectional view taken along direction A-A in FIG. 2.
Figure 7:
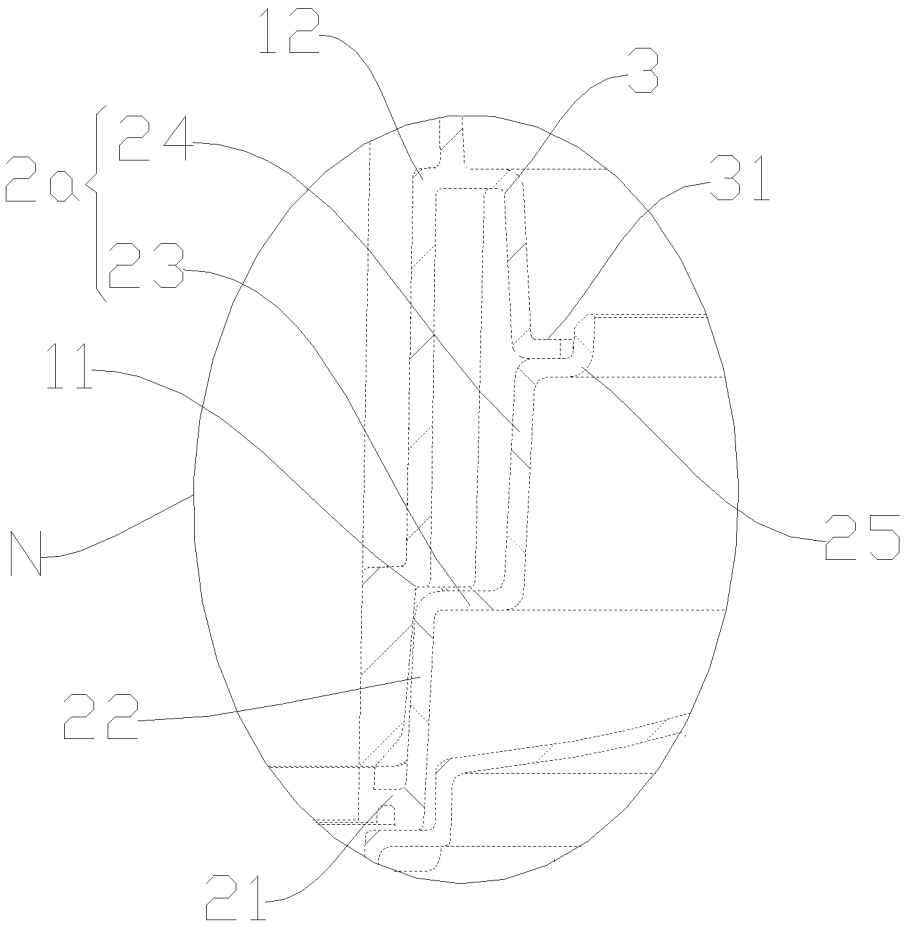
FIG. 7 is an enlarged view of position N in FIG. 6.

According to some embodiments of the present disclosure, as shown in FIGS. 3, 6 and 7, a first stepped portion 11 is formed on the inner peripheral wall of the first support portion 1, and a second stepped portion 2*a* abutting against the first stepped portion 11 is formed on the outer peripheral wall of the second support portion 2. Therefore, by arranging the first stepped portion 11 and the second stepped portion 2*a*, it is beneficial to improving the reliability of the abutment between the first support portion 1 and the second support portion 2 and the fitting strength between the first support portion 1 and the second support portion 2.

According to some optional embodiments of the present disclosure, the second support portion 2 includes: an annular chassis 21, an annular first connecting section 22, an annular second connecting section 23 and an annular third connecting section 24. The chassis 21 is arranged on an end surface of an axial end of the first support portion 1; the first connecting section 22 has one end connected to a radial inner end of the chassis 21 and the other end extending into the first support portion 1 in an axial direction; the second connecting section 23 has one end connected to the other end of the first connecting section 22 and the other end extending inwardly in a radial direction; the third connecting section 24 has one end connected to the other end of the second connecting section 23 and the other end extending in the axial direction away from the first connecting section 22; the second connecting section 23 and the third connecting section 24 define the second stepped portion 2*a*; the free end of the reinforcement plate 3 abuts against the other end of the third connecting section 24.

Figure 8:
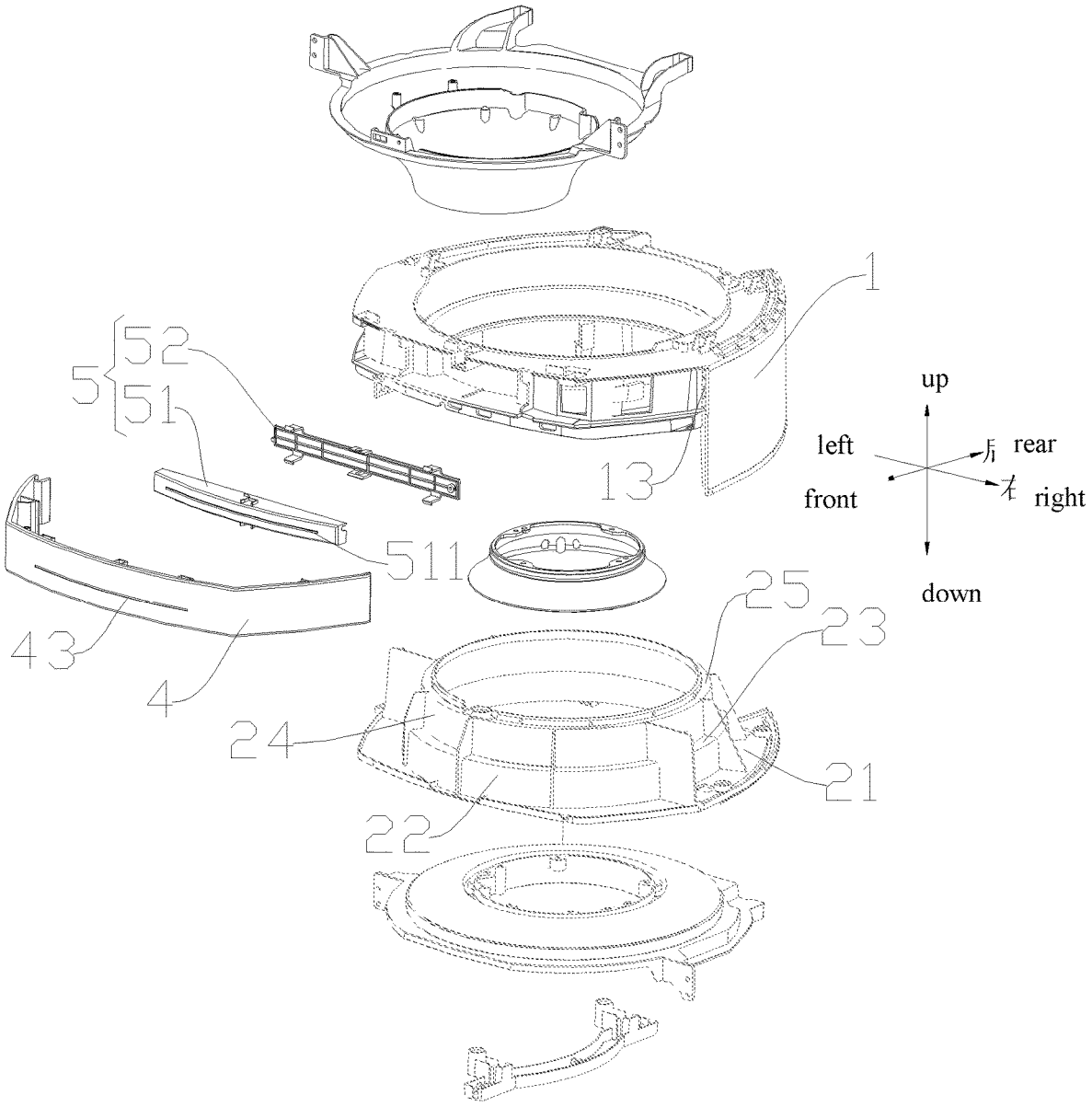
FIG. 8 is a schematic exploded diagram of a middle air duct support member according to some embodiments of the present disclosure.

For example, referring to FIGS. 6 and 8, in a direction from bottom to top, the second support portion 2 includes an annular chassis 21, an annular first connecting section 22, an annular second connecting section 23 and an annular third connecting section 24. The chassis 21 is arranged on a lower end surface of the first support portion 1; a lower axial end of the first connecting section 22 is connected to a radial inner end of the chassis 21 and the first connecting section 22 extends into the first support portion 1 in an axial direction; an outer radial end of the second connecting section 23 is connected to an upper axial end of the first connecting section 22 and the second connecting section 23 extends inwardly in a radial direction; a lower axial end of the third connecting section 24 is connected to an inner radial end of the second connecting section 23 and the third connecting section 24 extends upwardly in the axial direction; the second connecting section 23 and the third connecting section 24 define the second stepped portion 2*a*; the first stepped portion 11 of the first support portion 1 abuts against the second stepped portion 2*a*; a lower end of the reinforcement plate 3 abuts against an upper axial end of the third connecting section 24. As shown in FIG. 7, a fourth stepped portion 12 is formed on the inner peripheral wall of the first support portion 1 at the same level as the bent position on the reinforcement plate 3; and the second connecting section 23, the third connecting section 24, the reinforcement plate 3 and the inner peripheral wall of the first support portion 1 define a structure having a substantially square cross section. It can be understood that in other optional embodiments of the present disclosure, the fourth stepped portion 12 may not be provided.

Therefore, by configuring the structure of the second support portion 2 as extending multiple times in the axial direction and multiple times in the radial direction, it is beneficial to improving the structural strength of the second support portion 2, improving the fitting reliability of the second support portion 2 and the first support portion 1 and reducing a mold structure of the second support portion 2, thereby facilitating mold opening. In addition, a plurality of stepped structures are provided on the first support portion 1, which is also beneficial to improving the structural strength of the first support portion 1.

Further, the second support portion 2 further includes an annular fourth connecting section, one end of the fourth connecting section is connected to the other end of the third connecting section 24, and the fourth connecting section first extends inwardly in the radial direction and subsequently folds in a direction away from the third connecting section 24 to define the stepped portion 25. For example, as shown in FIGS. 6 to 8, one end of the fourth connecting section is connected to the upper axial end of the third connecting section 24, and the fourth connecting section extends inwardly in the radial direction and subsequently folds upwardly in the axial direction to define the stepped portion 25 so that the reinforcement plate 3 can be stopped on the stepped portion 25.

Therefore, by configuring the structure of the second support portion 2 as extending multiple times in the axial direction and multiple times in the radial direction, it is beneficial to improving the structural strength of the second support portion 2, improving the fitting reliability of the second support portion 2 and the first support portion 1 and reducing a mold structure of the second support portion 2, thereby facilitating mold opening.

According to some optional embodiments of the present disclosure, the reinforcement plate 3 extends along a circumferential direction to form an open-loop shape. In other words, the reinforcement plate 3 is not of a closed-loop structure and extends along the circumferential direction of the first support portion 1 to form an open-loop shape. For example, the reinforcement plate 3 extends along the circumferential direction of the first support portion 1 to form a semi-loop shape. Therefore, by ensuring the connection strength of the first support portion 1 and the second support portion 2, it is beneficial to saving material costs.

The present disclosure is not limited to this. In order to further improve the fitting strength of the first support portion 1 and the second support portion 2, the reinforcement plate 3 may be configured as a closed loop.

In some optional embodiments of the present disclosure, the free end of the reinforcement plate 3 is provided with a flanging 31 extending inwardly the radial direction, and the flanging 31 abuts against the stepped portion 25. In this way, since a contact area between the flanging 31 and the stepped portion 25 is relatively large, and the arrangement of the flanging 31 is beneficial to improving a stress area between the reinforcement plate 3 and the stepped surface and improving the fitting reliability of the reinforcement plate 3 and the second support portion 2.

Optionally, the reinforcement plate 3, the flanging 31 and the first support portion 1 are integrally formed parts, thereby facilitating simplification of the production process, reducing production costs, and improving the connection strength between the flanging 31 and the reinforcement plate 3.

It should be noted that the word "inwardly" in the expression "extending inwardly the radial direction" refers to a direction close to the central axis of the first support portion 1, and its opposite direction is outward.

In some optional embodiments of the present disclosure, the middle air duct support member 100 further includes a decorative member arranged on at least one of the outer peripheral walls of the first support portion 1 and the second support portion 2. In other words, the decorative member can be arranged only on the outer peripheral wall of the first support portion 1, or only on the outer peripheral wall of the second support portion 2. The decorative member can also be arranged partially on the outer peripheral wall of the first support portion 1 and partially on the outer peripheral wall of the second support portion 2. By arranging the decorative member, it is beneficial to improving the appearance effect of the middle air duct support member 100.

Figure 2:
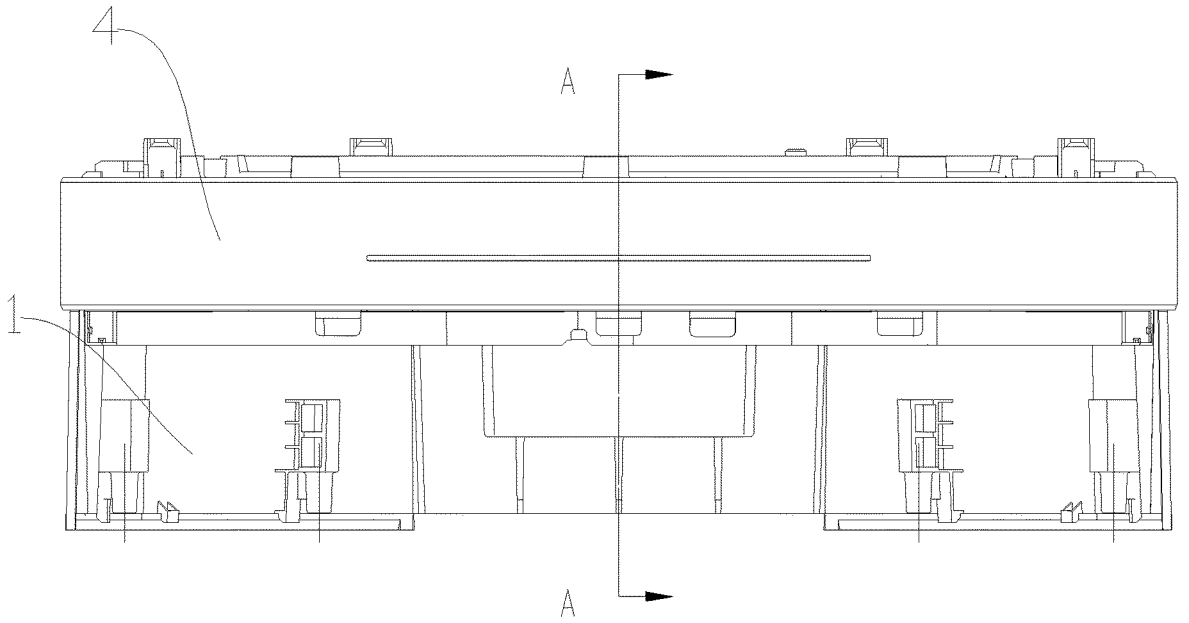
FIG. 2 is a schematic diagram of a first support portion and a decorative member in another direction according to some embodiments of the present disclosure when fitted.

For example, as shown in FIGS. 2 and 8, the decorative member includes a decorative board 4 and a light source box 5, the decorative board 4 can be arranged on the outer peripheral wall of the first support portion 1, and the decorative board 4 can cover at least a part of the outer peripheral wall of the first support portion 1, thereby improving the appearance and aesthetics of the middle air duct support member 100 and achieving a simple structure.

For example, the decorative board 4 is detachably arranged on the outer peripheral wall of the first support portion 1. This arrangement facilitates the disassembly and assembly of the decorative board 4 and is beneficial to improving the assembly efficiency. The light source box 5 is provided with a light-emitting strip (not shown). As shown in FIG. 8, at least part of the light source box 5 serves as a second transparent portion 511. In other words, the entire light source box 5 may be transparent; for example, the light source box 5 is configured as a transparent component;

alternatively, part of the light source box 5 may be transparent and the transparent part serves as the second transparent portion 511. At least part of the decorative board 4 serves as a first transparent portion 43. The second transparent portion 511 corresponds to the first transparent portion 43 on the decorative board 4, so that a light source emitted by the light-emitting strip can travel out through the second transparent portion 511 and the first transparent portion 43 and thus can be observed by the user, thereby improving the appearance and aesthetics of the middle air duct support member 100.

The light source box 5 is detachably arranged on an inner surface of the decorative board 4; that is, the light source box 5 is detachably arranged on a side surface of the decorative board 4 facing the first support portion 1 and is located between the decorative board 4 and the outer peripheral wall of the first support portion 1. This arrangement facilitates the disassembly and assembly of the light source box 5, which is beneficial to improving the assembly efficiency and maintenance efficiency of the decorative board 4 and the light source box 5. By this arrangement, after being assembled, the light source box 5 and the decorative board 4 can also be conveniently installed on the first support portion 1 as a whole, thereby achieving simple assembly. The present disclosure is not limited to this, and the decorative board 4 and the light source box 5 may be fixedly connected.

In some optional embodiments of the present disclosure, as shown in FIG. 8, the light source box 5 includes: a lamp holder 51 and a lamp cover 52. A receiving space with one side open is formed in the lamp holder 51, the light-emitting strip is arranged in the receiving space, the lamp cover 52 is arranged on the lamp holder 51 to cover the open side of the receiving space, and the second transparent portion 511 is arranged on a side wall of the lamp holder 51 opposite to the open side of the lamp holder 51. In this way, the installation and maintenance of the light-emitting strip in the receiving space can be facilitated.

In a further embodiment of the present disclosure, the lamp holder 51 and the lamp cover 52 are connected by a snap joint structure. For example, an outer sidewall of the lamp holder 51 is provided with a raised rib, an outer peripheral wall of the lamp cover 52 is provided with a flanging portion extending toward the lamp holder 51, and the flanging portion is provided with a fixing hole for engaging with the raised rib. By engaging the raised rib with the fixing hole, the snap joint connection between the lamp cover 52 and the lamp holder 51 is achieved and the advantages of simple structure and convenient installation are achieved.

Optionally, the lamp cover 52 and the flanging portion are integrally formed parts, which not only facilitates the simplification of the production process and reduces the production cost, but also improves the connection strength between the lamp cover 52 and the flanging portion thereby increasing the service life of flanging 31.

Figure 9:
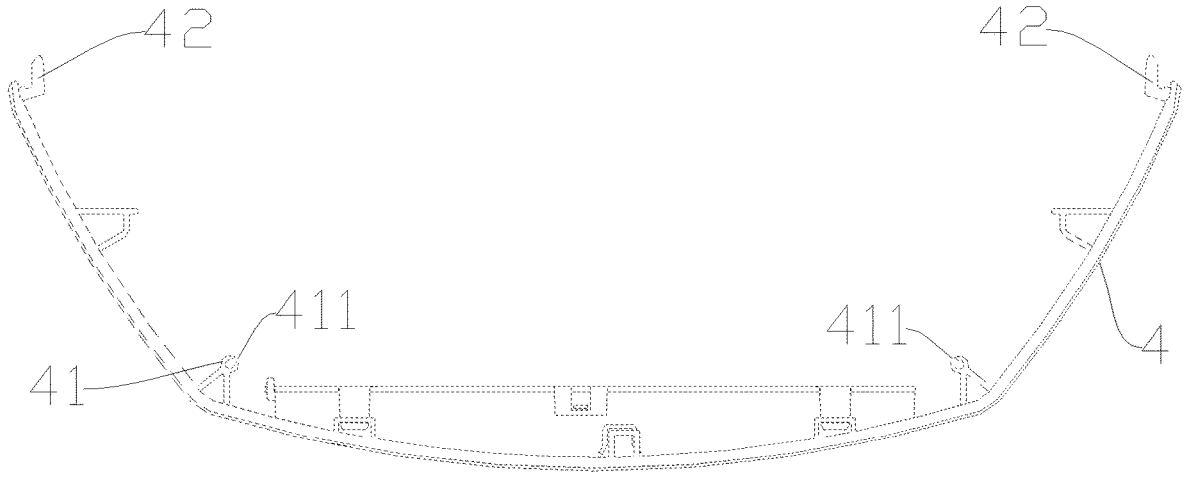
FIG. 9 is a schematic diagram of assembly of a decorative board and a light source box according to some embodiments of the present disclosure.

In some optional embodiments of the present disclosure, as shown in FIGS. 8 and 9, one of a locking groove 13 and a locking portion 42 is formed on the outer peripheral wall of the first support portion 1, and the other of the locking groove 13 and the locking portion 42 is formed on the decorative board 4. In other words, when the locking groove 13 is formed in the outer peripheral wall of the first support portion 1, the locking portion 42 is formed on the decorative board 4; and when the locking portion 42 is formed on the first support portion 1, the locking groove 13 is formed in the decorative board 4. In this way, through the engagement of the locking groove 13 and the locking portion 42, the detachable connection between the first support portion 1 and the decorative board 4 is achieved, which is convenient for disassembly and assembly and beneficial to improving the efficiency of assembly and maintenance.

For example, referring to FIGS. 8 and 9, the outer peripheral wall of the first support portion 1 is provided with two locking grooves 13 spaced apart along the circumferential direction of the first support portion 1, and two ends of the decorative board 4 in a length direction are each provided with a locking portion 42. For example, L-shaped locking portions 42 are arranged on inner surfaces, facing the first support portion 1, of two ends of the decorative board 4 in the length direction. Since the locking portions 42 and the locking grooves 13 are fitted one to one, the decorative board 4 can be detachably installed on the outer peripheral wall of the first support portion 1, which is convenient for disassembly and assembly and beneficial to improving production efficiency and maintenance efficiency.

In some optional embodiments of the present disclosure, the first support portion 1 and the decorative board 4 are connected by fasteners. For example, as shown in FIGS. 1 and 9, the first support portion 1 is provided with screw holes 14, and the inner surface of the decorative board 4 is provided with screw studs 41 that are fitted with the screw holes 14. The fasteners such as screws can pass through the screw holes 14 and be fixed on the screw studs 41.

For example, the screw stud 41 is defined with a notch 411 running through the screw stud 41 along an axial direction of the screw stud 41, so that the screw stud 41 can deform to some extent. In this way, screws of different sizes can be locked by the screw studs 41, which is beneficial to improving the universality of the decorative board 4 and facilitates the connection of the decorative board 4 with different first support portions 1.

Optionally, multiple screw studs 41 and screw holes 14 are provided respectively and fitted one to one. In this way, the reliability of the connection between the decorative board 4 and the first support portion 1 can be favorably improved and the decorative board 4 is prevented from falling off during long-term use, thereby avoiding problems such as the need for maintenance and replacement of the decorative board 4 when the decorative board 4 falls off and is damaged, reducing the maintenance cost, and improving the user experience and the user's recognition of the brand.

In some optional embodiments of the present disclosure, the light source box 5 is configured as a transparent component. In this way, it is convenient for the light of the light-emitting strip to pass through the light source box 5. Moreover, the light source box is simple and reliable, convenient for processing and manufacturing, and has a beautiful appearance.

In some optional embodiments of the present disclosure, the decorative board 4 is configured as an aluminum board. In this way, the cost is low, and the middle air duct support member 100 has metallic characteristics, which is beneficial to improving the appearance and aesthetics.

In some optional embodiments of the present disclosure, the first support portion 1 and the second support portion 2 are connected by fasteners. In this way, the reliability of the connection between the first support portion 1 and the second support portion 2 can be improved favorably.

As shown in FIG. 10, the air conditioner 1000 according to an embodiment of the present disclosure includes the above-mentioned middle air duct support member 100.

In the air conditioner 1000 according to the embodiment of the present disclosure, since the above-mentioned middle air duct support member 100 is provided and the first support portion 1 and the second support portion 2 are manufactured separately, mold opening can be carried out on the first support portion 1 and the second support portion 2 separately, which is beneficial to reducing the difficulty of mold processing and manufacturing, thereby reducing the difficulty of production; moreover, the first support portion 1 and the second support portion 2 can be manufactured at the same time, which is beneficial to improving the processing efficiency.

In the middle air duct support member 100 according to the embodiment of the present disclosure, by arranging the stepped portion 25, the free end of the reinforcement plate 3 can abut against one of the step surfaces of the stepped portion 25 and the other step surface can function to limit the position of the reinforcement plate, which is beneficial to improving the reliability of the abutment between the reinforcement plate and the second support portion, thereby improving the fitting reliability of the first support portion 1 and the second support portion 2.

In the description of the present disclosure, it should be understood that the orientation or position relationship indicated by the terms "up", "down", "front", "rear", "left", "right", "vertical", "horizontal", "axial", "radial", "circumferential" and the like are based on the orientation or position relationship shown in the accompanying drawings and are intended to facilitate the description of the present disclosure and simplify the description only, rather than indicating or implying that the apparatus or element referred to must have a particular orientation or be constructed and operated in a particular orientation, and therefore are not to be interpreted as limiting the present disclosure.

In the present disclosure, unless otherwise stated and defined explicitly, the terms such as "install" "link", "connect", and "fix" should be understood in a broad sense; for example, a connection may be a fixed connection, a detachable connection, or an integrated connection; may be a mechanical connection, an electrical connection or intercommunication; and may be a direct connection, an indirect connection through an intermediate medium, or a communication inside two components or interaction between two components. For those skilled in the art, the specific meanings of the above terms in the present disclosure can be understood based on a specific situation.

In the present disclosure, the first feature being "on" or "under" the second feature may mean that the first feature and the second feature are in a direct contact, or the first and second features may be not in a direct contact, but in an indirect contract through another feature therebetween, unless otherwise explicitly stated and defined. Moreover, the first feature being "at the top of", "above" and "on" the second feature may mean that the first feature is right above or above and to one side of the second feature, or may merely mean that the first feature is horizontally higher than the second feature. The first feature being "at the bottom of", "below" and "under" the second feature may mean that the first feature is below or below and to one side of the second feature, or may merely mean that the first feature is horizontally lower than the second feature.

Moreover, the terms "first" and "second" are used for descriptive purposes only and are not to be construed as indicating or implying a relative importance or implicitly indicating the number of technical features indicated. Thus, features defined by the term "first" or "second" may include one or more such features, either explicitly or implicitly. In the description of the present disclosure, the meaning of "a plurality of" is at least two, such as two, three, etc., unless specifically defined otherwise.

In the description of the present specification, the description with reference to the terms "one embodiment", "some embodiments", "exemplary embodiment", "example", "specific example", "some examples" or the like means specific features, structures, materials or characteristics described in connection with the embodiment or example are included in at least one embodiment or example of the present disclosure. In the present specification, the schematic representations of the above terms do not necessarily refer to the same embodiment. Moreover, the specific features, structures, materials, or characteristics described may be combined in a suitable manner in any one or more embodiments or examples.

While the embodiments of the present disclosure have been shown and described, it will be understood by those skilled in the art that the various modifications, changes, substitutions and variations of the embodiments may be made without departing from the spirit and scope of the invention. The scope of the invention is defined by the appended claims and their equivalents.

What is claimed is:

1. A middle air duct support member of an air conditioner, comprising:

an annular first support portion;

an annular second support portion arranged at an axial end of the annular first support portion, wherein the annular second support portion and the annular first support portion are manufactured separately; and a reinforcement plate provided on one of the annular first support portion and the annular second support portion, wherein the reinforcement plate is provided between the annular first support portion and the annular second support portion and is configured to abut against the other one of the annular first support portion and the annular second support portion, wherein the reinforcement place is provided on an inner peripheral wall of the annular first support portion, wherein the reinforcement plate is folded in an axial direction after extending inwardly in a radial direction, and wherein at least part of the annular second support portion extends into the annular first support portion and part of the inner peripheral wall of the annular first support portion and a free end of the reinforcement plate abut against an outer peripheral wall of the annular second support portion.

2. The middle air duct support member of the air conditioner according to claim 1, further comprising:

a first stepped portion provided on the inner peripheral wall of the annular first support portion; and a second stepped portion abutting against the first stepped portion and provided on the outer peripheral wall of the annular second support portion.

3. The middle air duct support member of the air conditioner according to claim 2, wherein the annular second support portion comprises:

an annular chassis arranged on an end surface of an axial end of the annular first support portion;

an annular first connecting section having one end connected to a radial inner end of the chassis and the other end extending into the annular first support portion in the axial direction;

an annular second connecting section having one end connected to the other end of the first connecting section and the other end extending inwardly in the radial direction; and an annular third connecting section having one end connected to the other end of the second connecting section and the other end extending in the axial direction away from the first connecting section, wherein the second connecting section and the third connecting section define the second stepped portion and the free end of the reinforcement plate abuts against the other end of the third connecting section.

4. The middle air duct support member of the air conditioner according to claim 1, wherein the reinforcement plate is configured to extend in a circumferential direction to form an open-loop shape.

5. The middle air duct support member of the air conditioner according to claim 1, further comprising a decorative member arranged on at least one of the outer peripheral walls of the annular first support portion and the outer peripheral walls of the annular second support portion.

6. The middle air duct support member of the air conditioner according to claim 5, wherein the decorative member comprises:

a decorative board detachably arranged on the outer peripheral wall of the annular first support portion; and a light source box provided between the decorative board and the outer peripheral wall of the annular first support portion, a light-emitting strip being provided in the light source box.

7. The middle air duct support member of the air conditioner according to claim 6, wherein the annular first support portion is defined with screw holes;

wherein an inner surface of the decorative board is provided with screw studs that are fitted with the screw holes; and wherein the screw stud is defined with a notch running through the screw stud along an axial direction of the screw stud.

8. An air conditioner comprising the middle air duct support member according to claim 1.

* * * * *